United States Patent [19]

Rassieur

[11] 4,456,079

[45] Jun. 26, 1984

[54] APPARATUS AND METHOD FOR TAKING SOIL SAMPLES

[75] Inventor: Charles L. Rassieur, Creve Coeur, Mo.

[73] Assignee: Central Mine Equipment Company, St. Louis, Mo.

[21] Appl. No.: 396,292

[22] Filed: Jul. 8, 1982

[51] Int. Cl.[3] ..... E21B 25/04

[52] U.S. Cl. ..... 175/58; 175/173; 175/171; 175/203; 175/248; 175/257

[58] Field of Search ..... 175/58, 20, 122, 173, 175/171, 203, 244, 246, 248, 257, 214, 243; 173/148, 149

[56] References Cited

U.S. PATENT DOCUMENTS

| | | | |
|---|---|---|---|
| 2,716,018 | 8/1955 | Williams | 175/171 |
| 2,929,452 | 3/1960 | Alexander | 175/257 |
| 3,703,212 | 11/1972 | Abrahams | 175/173 |
| 4,081,040 | 3/1978 | Henson | 175/246 |
| 4,148,367 | 4/1979 | Reich | 175/173 |

*Primary Examiner*—William F. Pate, III
*Assistant Examiner*—Mark Del Signore
*Attorney, Agent, or Firm*—Polster, Polster and Lucchesi

[57] ABSTRACT

In a rotary table driven hollow auger type sampling device, a rod is mounted at an end above the rotary table to be substantially fixed against rotation, but for axial movement. The rod extends through a hollow spindle driven by the table, and is fixedly mounted below the table to the upper end of a thin wall sampling tube mounted within a hollow auger to project a short distance below the lower end of the auger. The rod, hence the sampling tube, is forced downwardly with the auger, but is positively restrained from rotation.

8 Claims, 4 Drawing Figures

APPARATUS AND METHOD FOR TAKING SOIL SAMPLES

BACKGROUND OF THE INVENTION

For many years, rock samples have been obtained using core barrel assemblies. A diamond or carbide bit of a "doughnut" shape is connected to the outer tube of the core barrel assembly and when rotated cuts into rock. An inner tube that is bearing supported at the top is positioned just above the inner edge of the bit. The rock core sample enters the inner tube as the bit cuts the rock and advances. A drilling fluid is used to remove the cuttings at the area of the bit and transport them to the surface. The drilling fluid under pressure also prevents cuttings from entering between the core barrel inner tube and outer tube. The bearing at the top of the inner tube allows the inner tube to remain stationary as the core barrel assembly is rotated. This tends to prevent the inner, core retaining tube from rotating with the rotation of the outer tube of the core barrel, although the inner tube is not positively restrained against rotation.

The core barrel assembly can be removed after a five or ten foot run and the core removed. Another method is to remove only the inner tube, using a wireline cable. In this case, the inner tube has a latching means to lock it in its proper position within the outer tube. A bearing is also supplied between the latching means and the inner tube so that the inner tube will not rotate when the outer tube is rotated, provided that nothing binds between them.

U.S. patents illustrating such prior art barrel assemblies include Reed, U.S. Pat. Nos. 3,977,482 and Pickard, 3,120,282.

The obtaining of soil samples poses quite different problems from obtaining rock cores. Most soils are too soft to core, and in order to obtain an undisturbed sample, a thin wall tube is often pushed into the soil several feet. The soil sample is cut by the leading edge of the tube and is pushed into the sample tube. The tube is then extracted from the hole and the sample is later extruded from the tube. The hole is generally advanced using hollow stem auger or rotary drilling methods. One hollow stem auger design is covered by Rassieur U.S. Pat. No. Re. 26,938.

A hollow auger drill head is connected to the lead auger and the auger sections are connected to a drive cap that is rotated by the drill rig. In order to cut the center of the hole, a pilot assembly is positioned at the opening of the drill head and is connected to the drive cap with threaded drill rods. As the drive cap rotates, the center section and the hollow augers rotate together. It can be time consuming to remove the drill rods an pilot assembly, insert the sample tube and drill rods to obtain the sample, and to remove the sample and drill rods and reinsert the pilot assembly and rods.

Rassieur U.S. Pat. No. 3,241,624 covers a two-part rotary cutting head that includes a means to latch the pilot assembly into the bottom of the auger string and a means to retrieve and lower this assembly with a wireline cable. This device eliminates the use of drill rods with the pilot assembly. The drill rods need only be used with the sample tube.

Henson U.S. Pat. No. 4,081,040 covers a latching mechanism similar to Rassieur U.S. Pat. No. 3,241,624, and also allows the sample tube to be bearingly supported by the latching means so that the tube can protrude through the bottom of the hollow auger head. This is similar to the core barrels mentioned previously except that the inner tube protrudes through the bit and has a cutting edge. As the auger sections and head are turned, the tube is pressed into the ground and the sample forced into the tube. Friction between the tube that protrudes from the auger head and the soil tends to hold the tube stationary so that the augers can revolve around the tube and cut the hole. An advantage of this method is that the auger can be advanced and the sample taken at the same time. The inner rods are eliminated, increasing the speed of the operation. However, there are disadvantages. The tube needs to protrude out the bottom of the auger head a significant distance in order to attempt to prevent the tube from turning as the augers are turned, it being important that the soil sample not be rotated while it is being obtained. In wet, cohesive soil, the sample tends to be sucked out by the vacuum formed when the long tube is pulled up. In stiff material, the farther the tube protrudes out of the head, the more difficult it is to advance the hole. Another disadvantage is that material can force its way between the tube and the auger head causing the tube to rotate as the head and augers rotate, causing a spiraling of the sample and decreasing the sample's usefulness as an undisturbed laboratory sample. Another problem is that frequently material can come into the bottom of the auger string as the sampler is retrieved with the wireline and when reinserting the sampler and latching mechanism, it may not slide all the way to the bottom position, preventing the latching mechanism from functioning.

The problems of obtaining an undisturbed soil sample have been observed for many years. Hansen, U.S. Pat. No. 1,456,983, addressed the problem of keeping a sample tube from rotating, but the device of Hansen is complicated and not well adapted to use in modern drilling rigs.

The soil sampling method and apparatus of this invention, eliminates many of the problems with the wireline method. It allows the sampler to be positioned so that the cutting end is only slightly protruding from the auger head. It provides positive restraint against rotation of the sampling tube, thus eliminating completely the problem of spiraling of the sample. It provides these advantages in a modern drilling rig in which the auger is driven by a rotary table.

One of the objects of this invention is to provide a soil sampling apparatus and method that overcome problems that have been evident in the apparatus and methods known heretofore, in a simple way.

Other objects will become apparent to those skilled in the art in the light of the following description and accompanying drawing.

SUMMARY OF THE INVENTION

In accordance with this invention, generally stated, in a rotary table driven hollow auger type sampling device, a rod is mounted at an end above the rotary table to be substantially fixed against rotation, but connected for axial movement with axial movement of the rotary table. The rod extends through a hollow spindle driven by the table, and is fixedly mounted below the table to the upper end of a sampling tube mounted within a hollow auger to project a short distance below the lower end of the auger. The rod, hence the sampling tube, is forced downwardly with the auger, but is positively restrained from rotation. In the preferred embodiment, means are provided for permitting limited axial movement of the spindle with respect to the rod, to facilitate connection of the sample tube and auger to the rod and spindle, respectively.

DESCRIPTION OF THE PREFERRED EMBODIMENT

Figure 1:
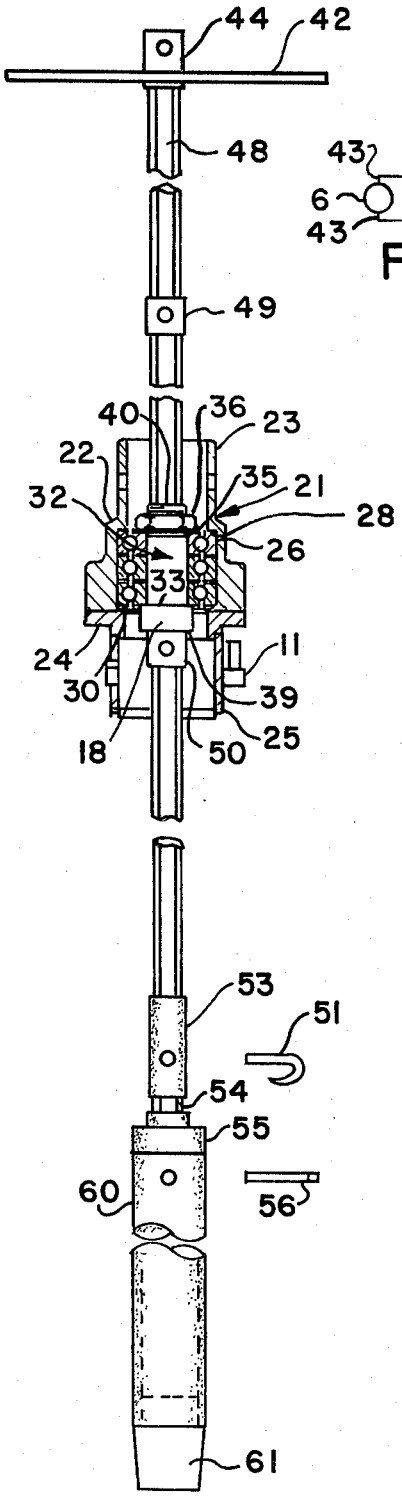
FIG. 1 is a fragmentary view in side elevation, partly in section, of one embodiment of soil sampling apparatus of this invention, the auger barrel being omitted for clarity.
Figure 4:
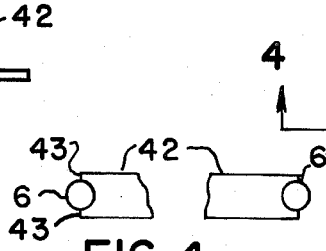
FIG. 4 is a sectional view taken along the line 4—4 of FIG. 3.

Referring now to the drawing for one illustrative example of soil sampling device of this invention, reference numeral 1 indicates a rotary table drill rig of the general type illustrated and described in Rassieur U.S. Pat. No. 3,561,545, with a rotary table 2, supported by a yoke 3. The yoke 3 is mounted on a pair of slide tubes 4, slidably mounted on a pair of hydraulic cylinders 5 for vertical movement thereon. A pair of pull-down rods 6, secured to the yoke 3, transmit the motion of pistons, not here shown, to the yoke 3. A hollow spindle 10 extends through the rotary table, for rotation with the rotary table, which is driven by a standard power transfer from the drill engine, not shown. This is standard, and it is one of the advantages of this invention that it is adapted to use with a standard rig. A yoke plate 42, with fingers 43 defining a semi-circular bay at each end slidably embracing the rods 6 to permit axial movement of the plate with respect to the rods but preventing rotational movement of the plate, is mounted between the rods 6. The yoke plate has a socket 44 welded or otherwise fixedly secured to its top surface and extending through an opening in the plate. The socket is open at its bottom, and is shaped and proportioned to receive the upper end of a hexagonal lock rod 48, and mount it against axial or rotational movement with respect to the plate.

A bearing assembly 21 has a housing with an upper part 22 with a hollow auger pin 23 of the type described in Rassieur U.S. Pat. No. Re. 26,938, and a separate lower part 24 that has a hollow auger box 25, as described in that patent. The lower part 24 is connected to the upper part 22 by means of bolts 11. Three sets of roller bearings 26 are stacked in the upper part 22, the outer race of the uppermost bearing resting against an annular inner shoulder 28 of the upper part 22, and the outer race of the lowermost bearing resting against an annular inner shoulder 30 provided by the lower part 24. A stabilizer 32 is mounted in and embraced by the inner race of the bearings 26. The stabilizer has on its lower end a radially outwardly extending enlarged part 18 defining a shoulder 33 bearing against the inner race of the lowermost bearing and a lower radial bearing surface 39, a cylindrical section with a smooth outer surface embraced by the inner races of the bearings, and a threaded upper end, a radially flat upper surface of which provides a bearing surface 40. A bearing washer 35 is placed over the threaded end, and a nut 36 is threaded onto that end to bring the washer 35 into engagement with the inner race of the uppermost bearing 26. The stabilizer 32 has an axial passage entirely through it, defined by a wall that is hexagonal in plan (a hex ID).

The spindle 10 is fitted with a hollow auger box 27 so that the hollow auger pin 23 of the bearing assembly 21 can slide into the hollow auger box and be secured by a threaded cap screw, thus mounting the bearing assembly concentrically with the spindle, for rotation therewith.

The hex lock rod 48 is inserted through the stabilizer 32 and upper and lower hex ID stop collars 49 and 50 are mounted on the lock rod 48 as by drive pins 51. The upper end of the rod 48 is then inserted in the socket 44 and secured, as by a drive pin 51. It will be observed that the stop collars are spaced axially a distance greater than the height of the stabilizer 32. In the arrangement shown in FIG. 1, the bottom of the lock rod 48 is fitted with a hex ID sleeve or sub 53 to slide over a hex ID shank 54 of a sample tube attachment sub 55, which is in turn mounted to the upper end of a sample tube 60 by means of a pin 56. The sample tube 60 has a sample shoe 61 mounted at its lower end, to provide a restricted cutting circle, giving the necessary clearance for the sample within the tube 60 and inhibiting accidental dislodgement of the sample.

Figure 2:
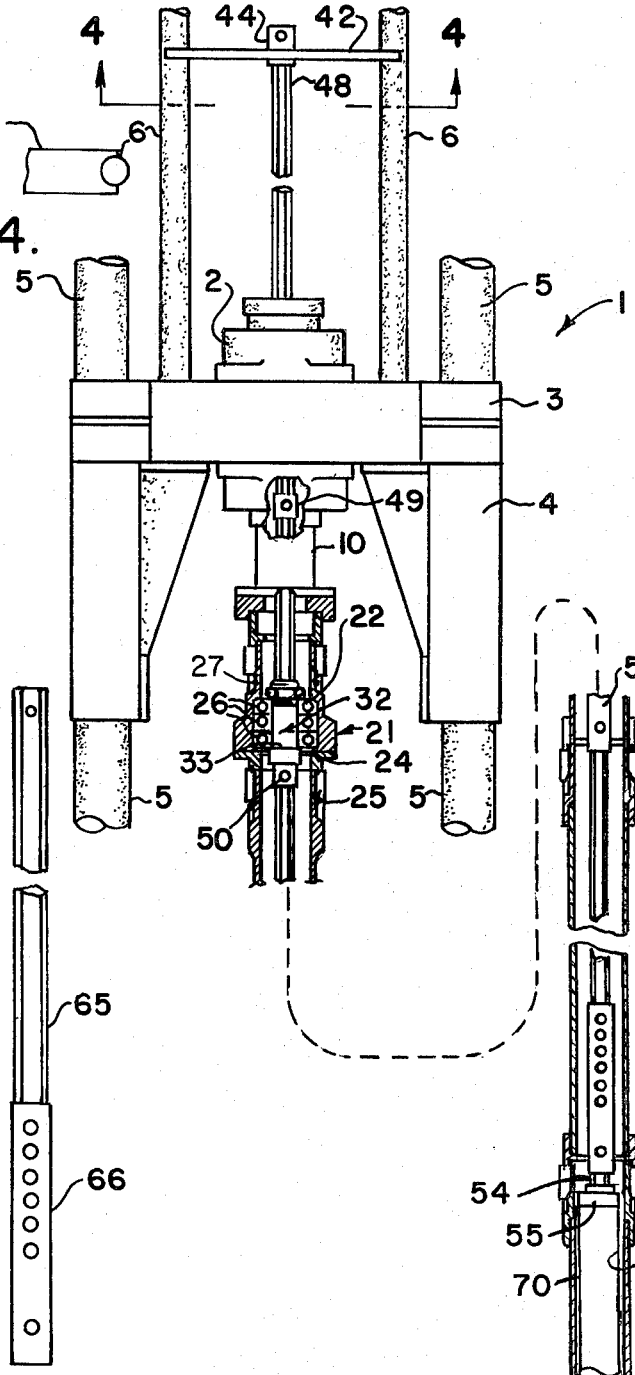
FIG. 2 is a view in side elevation, partly broken, of a rod with an adjustment sleeve.
Figure 3:
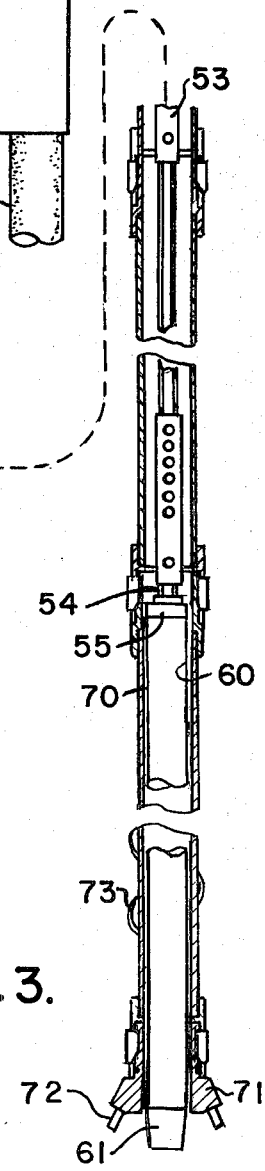
FIG. 3 is a view in side elevation, partly broken away, partly in section, of soil sampling apparatus of this invention, incorporating the adjustment sleeve of FIG. 2.

In the arrangement shown in FIGS. 2 and 3, an adjustment rod 65 is used, connected to the lower end of the lock rod 48. The adjustment rod 65 has a sub or sleeve 66 with a multiplicity of holes to permit the adjustment of the amount of projection of the sample tube from the lower end of an outer barrel 70.

The outer barrel 70 is preferably an auger, with external flights 73, at the lower end of which is the usual annular cutting head 71, with downwardly radially outwardly tending cutters 72. The barrel is conventionally made up of five foot sections, coupled together. The uppermost section is mounted in the auger box 25 of the lower part 24 of the bearing assembly for rotation therewith.

In the method of this invention, the sample tube 60 and sample tube attachment sub 55 are inserted inside the lead hollow auger barrel 70 and head 71, and both are stood upright with their lower ends on the ground and their upper ends concentric with the rotary table. The drill rotary is initially in raised position, at which position the upper bearing surface 39 of the stabilizer 32 is against the under side of the stop collar 49, and the sub 53 of the rod 48 is in its lowest position relative to the lower part 24 of the bearing assembly 21, i.e. it projects downwardly the farthest distance possible relative to the bearing assembly 21. The drill rotary is then lowered, allowing the hex ID sub 53 to slide over the shank 54 on the sample tube attachment sub 55, and to be secured thereto. Further downward movement of the rotary allows the connection of the hollow auger box 25 to a hollow auger pin of the barrel 70, because the resting of the shoe of the sample tube on the ground supports the lock rod 48 and permits the bearing assembly to move down with respect to the rod, hence the sample tube, until the lower bearing surface 40 of the stabilizer 32 bears against the lower stop collar 50. Unless the sample tube is on soft ground to permit it to move into the ground the distance it is to project from the hollow barrel, the barrel must be lifted that distance to be connected.

As the auger turns to advance the hole, the sample tube is positively prevented from turning by the rigid lock rod 48, locked from rotation by the yoke plate 42, bearing against the pull-down rods on the drill rig. After the augers have been advanced, the auger couplings are disconnected from the bearing assembly and the hex ID sub is disconnected from the sample tube attachment sub. The sample tube is then removed and the sample extracted. Because the sample tube is pulled independently from the auger barrels, it can be pulled in ten or fifteen foot or more lengths of rod at a time, depending upon the capacity of the rig. Additional samples are obtained by adding 5 foot hollow stem augers and using 5 foot hex rods in the center to connect the sample tube attachment sub with the hex ID sub 53. At least one of the intermediate hex rods can be the adjustment rod 65 shown in FIGS. 2 and 3.

The arrangement of this invention permits the use of a sample tube that projects only a short distance, e.g. approximately one or two inches beyond the end of the auger head, although, by using an adjusting rod or sub, various amounts of projection are possible. The use of a short projection, just enough to ensure the admission to the tube of an undisturbed soil sample, however, provides many advantages, as has been discussed in the background of the invention.

Numerous variations in the construction of the device of this invention and the method of its use, within the scope of the appended claims will occur to those skilled in the art in the light of the foregoing disclosure. Merely by way of example, the yoke plate 42 can have a different configuration, and can be held against rotation by some other member fixed with respect to the yoke 3 against rotation, although the pull-down rods 6 are convenient and effective for that purpose. The bearing assembly housing can take other forms than that of the coupling arrangement disclosed in Rassieur U.S. Pat. No. Re. 26,938, although that arrangement is simple, rugged and effective. The sub 53 can be made in the form of sub 66, so as to permit adjustment of the projection of the sample tube and shoe from the lead auger section initially. The outer barrel can be unflighted, although the provision of external flights is much preferred. For coring highly compacted soil or soft rock, the sample tube can be drawn back slightly above the auger head, rather than projecting below. The lock rod and its extensions can have a different cross-sectional configuration, a hex rod simply being standard in the industry. The use of a sample tube with a shoe in combination with a hollow auger mounted to rotate around the tube to sample as the auger is advanced, is believed to be novel in itself. Theses are merely illustrative.

I claim:

1. In apparatus for soil sampling including an outer hollow barrel and a sampling tube slidably mounted within said barrel, the improvement comprising an axially movable rotary drive table with a spindle with a central opening through it and means for coupling said barrel to it for rotation therewith, a rod having upper and lower ends, the lower end being fixedly connected to said sampling tube below said spindle, said rod extending intermediate its ends through and to a position above said spindle, and mounted above said spindle for movement axially with said table and fixed against rotary movement, whereby said sampling tube is positively restrained against rotation, and feed means for forcing said rod and barrel concurrently axially downwardly into the soil.

2. The apparatus of claim 1 wherein the sampling tube is thin walled and provided at its lower end with a sample shoe.

3. The apparatus of claim 1 or 2 wherein the barrel has an external flight.

4. The improvement of claim 1 including a shoe mounted in the lower end of said sampling tube and in a position with respect to said barrel at which the free end of the shoe is within the range of slightly above to projecting a short distance beyond the bottom of said barrel.

5. In apparatus for soil sampling including an outer hollow barrel and a sampling tube slidably mounted within said barrel, the improvement comprising an axially movable rotary drive table with a spindle with a central opening through it and means for coupling said barrel to it for rotation therewith, a rod having upper and lower ends, the lower end being fixedly connected to said sampling tube below said spindle, said rod extending intermediate its ends through and to a position above said spindle, and mounted above said spindle for movement axially with said table and fixed against rotary movement, whereby said sampling tube is positively restrained against rotation, a bearing assembly mounted for rotation on and with said spindle, said bearing assembly including a stabilizer revolvably mounted within said bearing assembly but fixed against axial movement with respect thereto, said stabilizer having upper and lower bearing surfaces, said rod extending slidably through said stabilizer, said rod having spaced stop means fixed thereto, one above and one below said stabilizer, said stop means being spaced axially of said rod a distance greater than the distance between the said upper and lower bearing surfaces, said bearing surfaces constituting the means by which axial force is transmitted to said rod, whereby said table can move axially for a limited distance independently of said rod.

6. The method of taking a soil sample comprising mounting on a rotary table type rig with a rotatably driven holow spindle a rod extending through said spindle and fixed at an upper end above said spindle against rotation, mounting on a lower end of said rod a sampling tube, mounting on said spindle for rotation therewith a hollow barrel mounted around said sampling tube, and forcing said barrel and sampling tube into the soil concurrently while rotating said barrel and holding said sampling tube positively against rotation.

7. The method of claim 6 wherein a lower end of said sampling tube is positioned with respect to said barrel within the range of slightly above to projecting a short distance beyond the lower end of said barrel.

8. The apparatus of claim 1 wherein said means for forcing said barrel and said rod axially downwardly concurrently at one position of said barrel and rod with respect to one another includes means for moving said barrel and said rod axially upwardly concurrently at another position of said barrel and rod with respect to one another, and means for permitting relative axial movement of said barrel and said rod intermediate said two positions.

* * * * *